US006926065B2

(12) United States Patent
Garin

(10) Patent No.: US 6,926,065 B2
(45) Date of Patent: Aug. 9, 2005

(54) CASTING SOLIDIFICATION EXPANSION MATERIALS

(76) Inventor: Michael Garin, 6582 Pheasant Run S., Lino Lakes, MN (US) 55014

( * ) Notice: Subject to any disclaimer, the term of this patent is extended or adjusted under 35 U.S.C. 154(b) by 0 days.

(21) Appl. No.: 10/670,700

(22) Filed: Sep. 24, 2003

(65) Prior Publication Data

US 2005/0061467 A1 Mar. 24, 2005

(51) Int. Cl.[7] ..... B22D 17/06

(52) U.S. Cl. ..... 164/306; 164/312

(58) Field of Search ..... 164/306, 307, 164/312, 113, 119, 120, 122, 155.1, 155.2

(56) References Cited

U.S. PATENT DOCUMENTS 4,497,359 A * 2/1985 Suzuki et al. ..... 164/120
4,932,458 A * 6/1990 Iwamoto et al. ..... 164/4.1

* cited by examiner

*Primary Examiner*—Jonathan Johnson
*Assistant Examiner*—Len Tran
(74) *Attorney, Agent, or Firm*—Jacobson & Johnson

(57) ABSTRACT

A mold that has an expandable mold cavity that is maintained at a first volume during an injection phase and expands to a second volume during the solidification phase to inhibit or prevent the formation of voids or cracks in a material that expands during the solidification process and a method whereby the pressure within a mold cavity during the solidification process is limited to inhibit or prevent formation of cracks or fissures in a cast article that normally expands during solidification.

4 Claims, 2 Drawing Sheets

CASTING SOLIDIFICATION EXPANSION MATERIALS

FIELD OF THE INVENTION

This invention relates to casting parts of a material that expands during the solidification stage and, more particularly, to casting fishing articles which contain bismuth metal.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

One of the problems with casting materials that expand during solidification is that the solidified materials often develop cracks or fractures that reduce the effectiveness and appeal of the cast product as well as the integrity of the product. This is particularly true in the sporting industry where bismuth and bismuth alloy metals are being touted to replace lead and lead alloy articles such as fishing sinkers. In order to remove such a cast article from a mold, the molds have been made in multiple parts that allow the mold parts to be removed in sections thereby preventing the cast article from being retained in the mold cavity due to an interference fit between the mold surfaces and the surfaces of the solidified cast article.

In contrast to the above method of separating the mold parts after a cast article has been cast, the present invention relates to formation of cast article by use of a mold cavity that expands during the solidification phase to maintain or limit the increase in an internal pressure in the mold cavity and hence in the cast article. The pressure within the cavity is maintained at a pressure less than what can be consider a "fracture pressure" during the solidification phase of the cast article but equal or greater than the injection molding pressure. By fracture pressure it is meant that if the cast article solidified under such pressure that the cast article would contain cracks or voids that render the cast article undesirable for the intended use.

During the casting of parts with materials such as bismuth and bismuth alloys in a fixed volume mold it has been found that there are voids or cracks in the finished part. Normally, a void or crack in a finished part is a result of having insufficient material in the mold cavity as the metal solidifies. In the present invention, it appears that the voids or cracks are not formed as a result of having an insufficient amount of material in the mold cavity but as a result of the increase of the pressure during the solidification phase. While the exact mechanism of why the increase in solidification pressure can result in cracks and voids in the finished product is not fully understood, the present invention provides a method and apparatus that inhibits or eliminates the voids or cracks in the finished product by reducing mold pressure on the article. In the preferred embodiment a mold having a mold cavity that expands during the solidification phase to limit an increase in internal pressure in the cast article during the solidification phase is used to form a cast article.

SUMMARY OF THE INVENTION

Briefly, the present invention comprises a mold that has an expandable mold cavity that is maintained at a first volume during an injection phase and expands to a second volume during the solidification phase to inhibit or prevent the formation of voids or cracks in a material that expands during the solidification process and a method whereby the pressure within a mold cavity during the solidification process is limited to inhibit or prevent formation of cracks or fissures in a cast article that expands during a solidification stage.

DESCRIPTION OF THE PREFERRED EMBODIMENT

Figure 1:
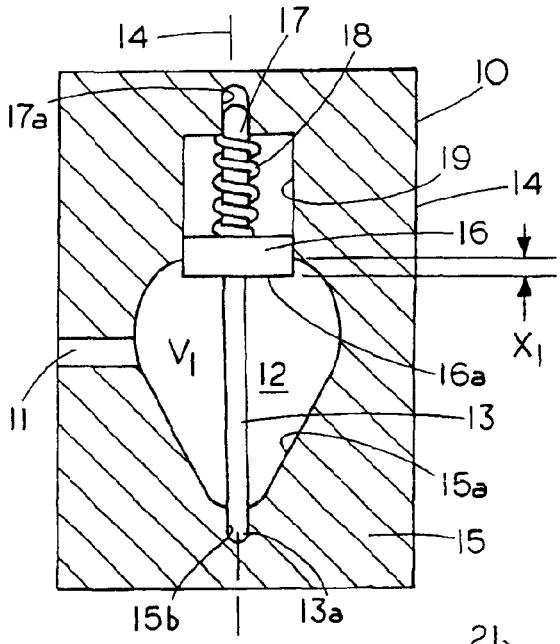
FIG. 1 is a cross sectional view of a mold in an injection condition.

Referring to FIG. 1, reference numeral 10 identifies the expandable mold of the present invention that is used to form a conventional egg shaped fishing sinker having a central opening therethrough. The expandable mold 10 is particularly useable with materials, such as bismuth and bismuth alloys, that expand during the solidification phase. Mold 10 can be used to form a fishing sinker of non uniform size, for example, with the fishing sinker having at least one region of greater mass than an adjoining region as evidenced by the pear shaped configuration of cavity 12 in FIG. 1.

Mold 10 includes an inlet port 11 that connects to a mold cavity 12, which is formed by a first mold part 15 having a fixed mold surface 15*a* and a second movable mold part 16 having a movable mold surface 16*a* that is displaceable relative to mold surface 15*a*. Mold cavity 12, which is shown in the casting condition, has a mold volume identified as $V_1$. The movable mold part 16 is slidable along an axis 14 much like a piston slides in a cylinder and is laterally stabilized and supported by a cylindrical side wall 19 and by an upward extension member 17 thereon that is axially slidable within a guide slot 17*a* located in fixed mold part 15.

A compression spring 18 extends around extension member 17. Compression spring 18 exerts a downward force on mold part 16 causing mold part 16 and consequently mold surface 16*a* to extend into the cavity 12 a distance beyond the normal end of mold surface 15*a* with the distance between the mismatched surfaces denoted by $X_1$. Mold part 16 while slidable along sidewall 19 is limited in the downward movement by either the spring 18 or a stop in order to provide a closed casting volume for receiving the molten metal.

In the embodiment shown, an extension member 13 extends from the movable mold part 16 to form an opening in the cast article. The end of extension 13 is received by a guide slot 15*b* in mold part 15. In this embodiment the end 13*a* of extension 13 can be used in conjunction with the guide slot 15*b* to form a stop to limit downward movement of mold part 16. In other embodiments, not having a central extension, a stop can be incorporated into movable member 16 and mold part 15.

The mold 10, as illustrated in FIG. 1, is in the casting condition with a casting volume designated by $V_1$. In order to maintain the volume of the mold in the casting condition spring 18 is preloaded so as to generate sufficient pressure to retain mold part 16 in place during the injection phase. That is, if molten metal is injected at a pressure $P_1$ the pressure $P_1$ is insufficient to cause retraction of moveable mold part 16 into a retraction cavity 19*a*. However, when the pressure in mold cavity 12 begins to increase, as a result of the expansion of the metal during the metal solidification phase, the compression spring 18 retracts allowing the volume of the mold cavity 12 to increase thereby inhibiting the solidification pressure from substantially increasing as a result of the conflict between the expansion forces of the solidifying molten metal and the immovable mold surfaces which can producing stress cracks or voids in a cast article.

Figure 2:
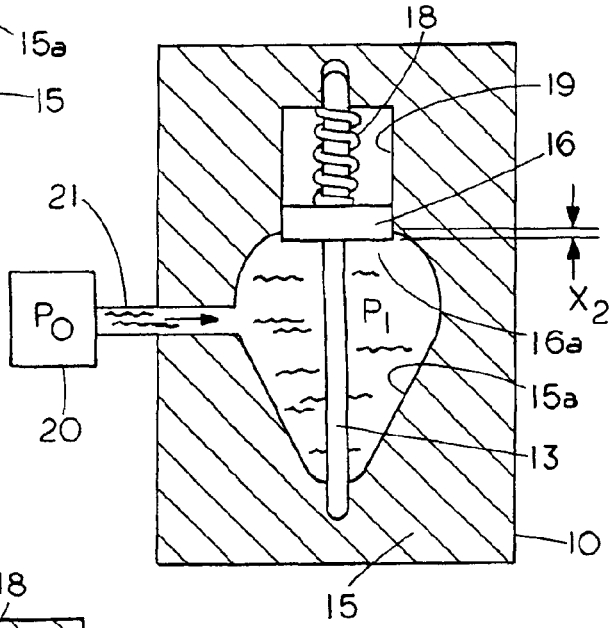
FIG. 2 is a cross section of the mold of FIG. 1 in the injection condition.

A reference to FIG. 2 shows the mold 10 in a condition when the metal therein has begun to solidify. That is, the molten metal from supply source 20 has been injected through port 21 into the cavity and the supply of molten metal from source 20 has been shut off. In this condition, as the pressure of the metal in the mold increases, in response the movable mold part 16 slides axially upward as indicated by the decreased difference $X_2$ between the mold surface 16*a* and mold surface 15*a*.

Figure 3:
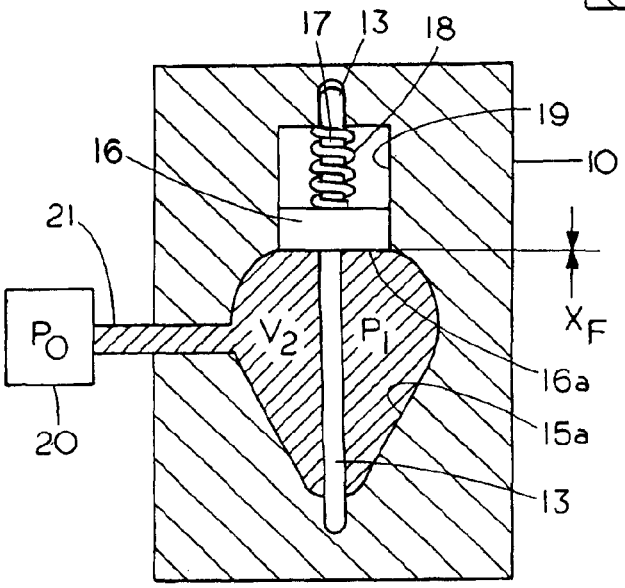
FIG. 3 is a cross section view of the mold of FIG. 1 in the solidification condition.

A reference to FIG. 3 shows the mold 10 in the solidification condition. In the solidification condition, the mold part 16 has slid upward until the movable mold part face 16*a* is in alignment with fixed mold face 15*a*, which is indicated by the distance $X_f$ equal to 0. In this condition, the mold cavity has a final volume $V_2$ with the final volume $V_2$ resulting from the retraction of the movable mold part 16 as a result of the pressure $P_1$ in mold cavity 12. That is, as the solidification continues and the metal expands it pushes member 16 against spring 18 which responds by compressing to allow the mold cavity 12 to increase in volume. The increase in mold cavity volume limits the increased solidification pressure of the molten metal that would normally occur if the volume of the mold cavity were kept constant during the injection and solidification phase.

Figure 4:
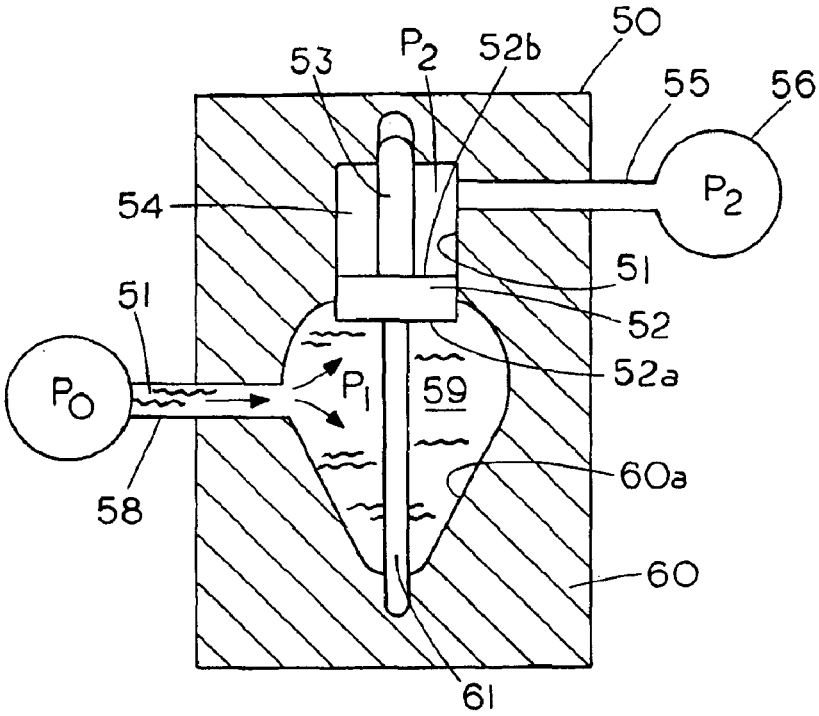
FIG. 4 is cross sectional view of an alternate embodiment of the solidification expansion mold of the present invention.

FIG. 4 shows an alternate embodiment to the invention wherein mold 50 includes a fixed mold part 60 and a movable mold part 52 with a movable mold face 52*a*. A source of molten metal 57 under a pressure $P_o$ is shown connected to mold 50 though a conduit 58. The molten metal flows into mold cavity 59 under pressure $P_1$, which is known as the injection pressure.

In the embodiment of FIG. 4 the movable member 52 is maintained in the casting condition by maintaining the fluid pressure $P_2$ in chamber 54. That is an external pressure supply 56 supplies fluid under pressure $P_2$ to chamber 54 which acts on face 52*b* to force member 52 downward. The extension member 61, which functions as a stop, limits the downward movement to member 52 while the pressure acting on face 52*b* limits the upward movement of member 52. In this embodiment the pressure $P_2$ is maintained such that the member 52 remains in the condition shown in FIG. 4 until the solidification phase begins. In this condition the injection pressure $P_1$ is such that it is insufficient to cause retraction of member 52. However, once the supply of molten metal to chamber 59 is shut off and the solidification phase begins the solidified metal begins to expand and exert an upward pressure that overcomes the pressure $P_2$ causing a retraction of member 52 to the condition wherein the two mold surfaces are mated with each other. That is mold surface 52*a* and 60*a* become aligned to form a continuous surface. While a continuous surface between the movable mold surface 52*a* and the fixed mold surface 60*a* can be obtained with the present invention by balancing the expansion forces with the retaining forces, the present invention can also be used in those cases where there is not a continuous surface between the fixed mold surface and the movable mold surface.

Figure 5:
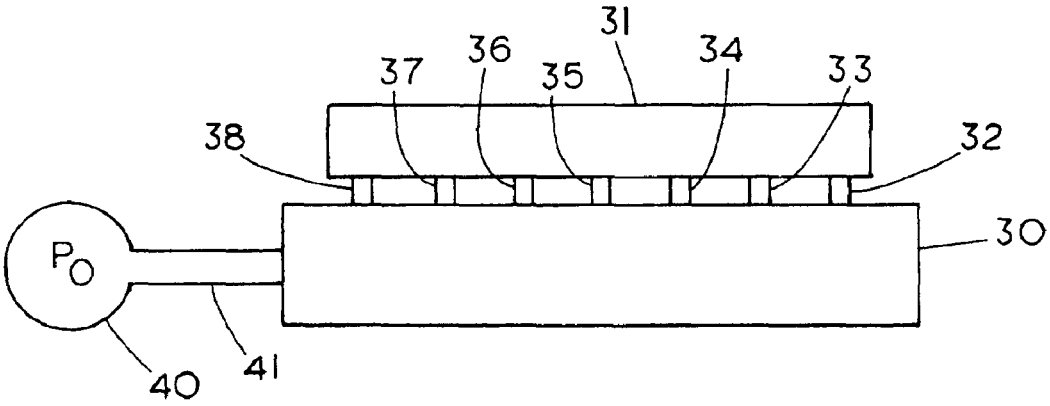
FIG. 5 is a schematic view of a system for simultaneously injecting an expandable material into a set of cavities in a mold.

FIG. 5 shows an alternate embodiment of a system wherein a multiple cavity mold 30 that includes both a fixed surface and a movable surface in each of the mold cavities (not shown). The mold 30 connect to a source of molten metal 40 by a conduit 41 which can inject molten metal under an injection pressure $P_O$. In this embodiment a manifold 31 having a set of conduits 32–38 which respectively connect to a retraction chamber, which is illustrated in FIG. 4, allows each of the movable mold parts in the mold cavities to move in response to the solidification pressure. That is, the manifold 31 is connected to source of fluid under a pressure that normally maintains the force against the moveable mold part so that the injection pressure does not displace the movable mold part. The increase in internal pressure in the mold cavity as a result of the solidification of the metal eventually causes the movable mold part to retract as described herein before and thereby prevent the internal solidification pressure from reaching levels that would cause the cast article to reach a fracture pressure that results in cracks or voids in the cast article that could render the cast article unsuitable for use.

The present invention as illustrated includes a pressure responsive mold 10 with a mold part 15 having a fixed sidewall 15*a* defining a portion of an exterior surface of a pressure cast article. A retractable member 16 having a face 16*a* for defining a further portion of the exterior surface of a pressure cast article with the face 16*a* and the fixed sidewall 15*a* forming a cavity 12 of a first volume $V_1$ when the mold is in an unpressurized condition. An entry port 11 allows one to introduce a molten metal that expands during a solidification phase into a cavity 12 in the mold. A retaining member comprising a compression spring 18 maintains movable face 16*a* with a movable sidewall at least partially in the cavity 51 of the mold during the casting of an article to maintain the first volume $V_1$. The retaining member 18 is retractable in response to an increase in mold pressure in cavity 12 caused by solidifying of the article therein to bring the face into alignment with the sidewall to thereby form a solidification cavity wherein the face and the fixed sidewall are contiguous with each other. In an alternate embodiment the face and the sidewall are not in contiguous alignment with each other but in either case the solidification pressure is maintained at a level such that the cast article does exhibit cracks and voids that would render the part unsuitable.

With the present invention one can cast an article from a metal that expands during solidification by introducing a metal at a first pressure into a mold cavity and maintaining a pressure in the mold cavity which is greater than the first pressure but is less than a fracture pressure to thereby inhibit or prevent the formation of voids or cracks in the cast article.

I claim:

1. A pressure responsive mold for casting a fishing sinker containing bismuth:

a mold part having a fixed sidewall, said fixed sidewall defining a portion of an interior mold surface;

a retractable member, said retractable member having a face for defining a further portion of an interior mold surface, said face and said fixed sidewall forming a cavity having a casting volume;

an entry port for introducing a molten metal that expands during a solidification phase into the cavity in the mold; and a retaining member, said retaining member maintaining said interior mold surface and said face in position during an injection of a molten material therein, said retaining member retractable in response to an increase in the cavity pressure caused by solidification to displace the face relative to the sidewall to thereby form a solidification cavity wherein the face and the fixed sidewall contain a solidification volume that is greater than the casting volume.

2. The pressure responsive mold of claim 1 wherein the retaining member comprises a spring.

3. The pressure responsive mold of claim 2 wherein the spring is loaded to generate a force that is unresponsive to movement of the face until the solidification pressure exceeds the injection pressure.

4. The pressure responsive mold of claim 1 wherein the retaining member includes a source of pressurized fluid.

* * * * *